US007182157B2

(12) United States Patent
Zupanick

(10) Patent No.: US 7,182,157 B2
(45) Date of Patent: Feb. 27, 2007

(54) ENLARGING WELL BORES HAVING TUBING THEREIN

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 225 days.

(21) Appl. No.: 11/019,694

(22) Filed: Dec. 21, 2004

(65) Prior Publication Data

US 2006/0131076 A1 Jun. 22, 2006

(51) Int. Cl.
*E21B 10/32* (2006.01)
*E21B 4/02* (2006.01)

(52) U.S. Cl. ..... 175/267; 175/263; 175/107; 175/406

(58) Field of Classification Search ..... 175/102, 175/97, 263, 321, 325.5, 382, 53, 107, 267, 175/406

See application file for complete search history.

(56) References Cited

U.S. PATENT DOCUMENTS

| | | | |
|---|---|---|---|
| 54,144 | A | 4/1866 | Hamar |
| 130,442 | A | 8/1872 | Russell |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,230,666 | A | 6/1917 | Carden |
| 1,285,347 | A | 11/1918 | Otto |
| 1,317,192 | A | 9/1919 | Jones |
| 1,467,480 | A | 9/1923 | Hogue |
| 1,485,615 | A | 3/1924 | Jones |
| 1,498,463 | A | 6/1924 | McCloskey et al. |
| 1,589,508 | A | 6/1926 | Boynton |
| 1,674,392 | A | 6/1928 | Flansburg |
| 1,710,998 | A | 4/1929 | Rudkin |
| 1,970,063 | A | 8/1934 | Steinman |
| 2,018,285 | A | 10/1935 | Schweitzer et al. |
| 2,031,353 | A | 2/1936 | Woodruff |
| 2,033,521 | A | 3/1936 | Horn |

(Continued)

FOREIGN PATENT DOCUMENTS

| | | | |
|---|---|---|---|
| CA | 1067819 | A | 12/1979 |

(Continued)

OTHER PUBLICATIONS

Nackerud Product Description, Harvest Tool Company, LLC, Received Sep. 27, 2001, 1 page.

(Continued)

*Primary Examiner*—David J. Bagnell
*Assistant Examiner*—Daniel P Stephenson
(74) *Attorney, Agent, or Firm*—Fish & Richardson P.C.

(57) ABSTRACT

An underreamer for forming a cavity within a well bore includes a fluid motor having a first body and a second body arranged about a longitudinal axis. The first body is adapted to rotate about the longitudinal axis in relation to the second body when fluid is passed between the first and second bodies. The fluid motor further defines a longitudinal tubing passage adapted to allow passage of the fluid motor over a tubing string. At least one cutting arm is coupled to rotate with the first body, and radially extendable into engagement with an interior of the well bore to form the cavity.

16 Claims, 12 Drawing Sheets

U.S. PATENT DOCUMENTS 2,069,482 A 2/1937 Seay
2,150,228 A 3/1939 Lamb
2,169,502 A 8/1939 Santiago
2,169,718 A 8/1939 Böll et al.
2,203,998 A 6/1940 O'Grady
2,250,912 A * 7/1941 Hudson et al. ..... 175/99
2,290,502 A 7/1942 Squires
2,450,223 A 9/1948 Barbour
2,490,350 A 12/1949 Grable
2,662,486 A 12/1953 Hillger
2,679,903 A 6/1954 McGowen, Jr. et al.
2,814,463 A 11/1957 Kammerer, Jr.
2,847,189 A 8/1958 Shook
3,087,552 A 4/1963 Graham
3,107,731 A 10/1963 Dinning
3,126,065 A 3/1964 Chadderdon
3,196,961 A 7/1965 Kammerer
3,236,320 A 2/1966 Russ
3,339,647 A 9/1967 Kammerer
3,378,069 A 4/1968 Fields
3,379,266 A 4/1968 Fletcher
3,397,750 A 8/1968 Wicklund
3,443,648 A 5/1969 Howard
3,528,516 A 9/1970 Brown
3,530,675 A 9/1970 Turzillo
3,552,509 A 1/1971 Brown
3,554,304 A 1/1971 Link
3,598,193 A 8/1971 Hilton
3,656,564 A 4/1972 Brown
3,684,041 A 8/1972 Kammerer, Jr., et al.
3,731,753 A 5/1973 Weber
3,757,876 A 9/1973 Pereau
3,757,877 A 9/1973 Leathers
4,073,351 A 2/1978 Baum
4,083,653 A 4/1978 Stiffler
4,116,012 A 9/1978 Abe et al.
4,151,880 A 5/1979 Vann
4,158,388 A 6/1979 Owen et al.
4,169,510 A 10/1979 Meigs
4,189,184 A 2/1980 Green
4,243,099 A 1/1981 Rodgers, Jr.
4,245,699 A 1/1981 Steeman
4,278,137 A 7/1981 Van Eek
4,323,129 A 4/1982 Cordes
4,366,988 A 1/1983 Bodine
4,396,076 A 8/1983 Inoue
4,398,769 A 8/1983 Jacoby
4,401,171 A 8/1983 Fuchs
4,407,376 A 10/1983 Inoue
4,494,616 A 1/1985 McKee
4,549,630 A 10/1985 Brown
4,558,744 A 12/1985 Gibb
4,565,252 A 1/1986 Campbell et al.
4,618,009 A 10/1986 Carter et al.
4,674,579 A 6/1987 Geller et al.
4,715,440 A 12/1987 Boxell et al.
4,830,105 A 5/1989 Petermann
4,887,668 A 12/1989 Lynde et al.
5,009,273 A 4/1991 Grabinski
5,036,921 A 8/1991 Pittard et al.
5,074,366 A 12/1991 Karlsson et al.
5,111,893 A 5/1992 Kvello-Aune
5,135,058 A 8/1992 Millgard et al.
5,148,875 A 9/1992 Karlsson et al.
5,168,942 A 12/1992 Wydrinski
5,174,374 A 12/1992 Hailey
5,197,553 A 3/1993 Leturno
5,201,817 A 4/1993 Hailey
5,242,017 A 9/1993 Hailey
5,255,741 A 10/1993 Alexander
5,271,472 A 12/1993 Leturno
5,348,091 A 9/1994 Tchakarov et al.
5,363,927 A 11/1994 Frank
5,385,205 A 1/1995 Hailey
5,392,862 A 2/1995 Swearingen
5,402,856 A 4/1995 Warren
5,413,183 A 5/1995 England
5,419,396 A 5/1995 Palmer et al.
5,494,121 A 2/1996 Nackerud
5,499,687 A 3/1996 Lee
5,722,489 A 3/1998 Lambe et al.
5,853,054 A 12/1998 McGarian et al.
6,070,677 A 6/2000 Johnston, Jr.
6,082,461 A 7/2000 Newman et al.
6,142,232 A 11/2000 Troutt et al.
6,217,260 B1 4/2001 He
6,227,312 B1 5/2001 Eppink
6,302,666 B1 * 10/2001 Grupping ..... 418/188
6,378,626 B1 4/2002 Wallace
6,412,556 B1 7/2002 Zupanick
6,454,000 B1 9/2002 Zupanick
6,454,024 B1 9/2002 Nackerud
6,494,272 B1 12/2002 Eppink et al.
6,533,035 B2 3/2003 Troutt et al.
6,575,255 B1 6/2003 Rial et al.
6,591,922 B1 7/2003 Rial et al.
6,595,301 B1 7/2003 Diamond et al.
6,595,302 B1 7/2003 Diamond et al.
6,644,422 B1 11/2003 Rial et al.
6,681,855 B2 1/2004 Zupanick et al.
6,722,452 B1 4/2004 Rial et al.
6,761,219 B2 7/2004 Snider et al.
6,923,275 B2 8/2005 Gardes
2002/0070052 A1 6/2002 Armell et al.
2004/0011560 A1 1/2004 Rial et al.
2004/0074672 A1 * 4/2004 Rives ..... 175/57
2004/0084183 A1 5/2004 Zupanick
2004/0206493 A1 10/2004 Zupanick et al.
2004/0206547 A1 10/2004 de Luca
2004/0222022 A1 * 11/2004 Nevlud et al. ..... 175/57
2005/0092525 A1 * 5/2005 Teale et al. ..... 175/57

FOREIGN PATENT DOCUMENTS

DE 12 07 907 B 12/1965
EP 0 300 627 A1 1/1989
WO WO 01/83932 A1 11/2001

OTHER PUBLICATIONS

Zupanick et al, "Cavity Positioning Tool and Method," U.S. Appl. No. 10/188,159, Jul. 1, 2002 (28 pages).

Notification of Transmittal of the International Search Report or the Declaration (PCT Rule 44.1) (3 pages) and International Search Report (7 pages) re International Application No. PCT/US 03/04771 mailed Jul. 4, 2003 (International Pub. #WO 03/071087 A1).

Notification of Transmittal of the International Search Report or the Declaration (PCT Rule 44.1) (3 pages) and International Search Report (5 pages) re International Application No. PCT/US 03/14828 mailed Sep. 2, 2003 (International Pub. #WO 03/102355 A1).

Notification of Transmittal of the International Search Report or the Declaration (PCT Rule 44.1) (3 pages) and International Search Report (5 pages) re International Application No. PCT/US 03/21891 mailed Nov. 13, 2003 (International Pub. #WO 2004/007900).

Zupanick et al., "Cavity Positioning Tool and Method," U.S. Appl. No. 10/687,362, Oct. 14, 2003 (27 pages).

E-Tronics, ABI Oil Tools, Tubing Rotator Operating Effectiveness, Jun. 2002 (1 page).

Invitation to pay Additional Fees (3 pages) and Annex to Form PCT/ISA/206 Communication Relating to the Results of the Partial International Search (2 pages) for International Application No. PCT/US2005/046431 mailed May 2, 2006.

Notification of Transmittal of the International Search Report and the Written Opinion of the International Searching Authority, or the Declaration (1 page), Notes to Form PCT/ISA/200 (2 pages), International Search Report (7 pages), and Written Opinion of the International Searching Authority (8 pages) for International Application No. PCT/US2005/046431 mailed Aug. 14, 2006.

* cited by examiner

ENLARGING WELL BORES HAVING TUBING THEREIN

The present application incorporates by reference the following concurrently filed U.S. patent applications: Perforating Tubulars, listing Joseph A. Zupanick as inventor and U.S. patent application Ser. No. 11/019,748 and Accessing Subterranean Resources by Formation Collapse, listing Joseph A. Zupanick as inventor, and U.S. patent application Ser. No. 11/019,757.

TECHNICAL FIELD

The present invention relates generally to enlarging well bores, and more particularly, to systems, apparatus, and methods for enlarging well bores having tubing therein.

BACKGROUND

Subterranean deposits of coal, also referred to as coal seams, contain substantial quantities of entrained resources, such as coal seam gas (including methane gas or other naturally occurring gases). Production and use of coal seam gas from coal deposits has occurred for many years. However, substantial obstacles have frustrated more extensive development and use of coal seam gas deposits in coal beds.

In the past, coal seam gas was extracted through multiple vertical wells drilled from the surface into the subterranean deposit. Coal seams may extend over large areas of up to several thousand acres. Vertical wells drilled into the coal deposits for obtaining methane gas can drain only a fairly small radius into the coal deposits around the wells. Therefore, to effectively drain a coal seam gas deposit, many vertical well bores must be drilled. Many times, the cost to drill the many vertical well bores is not justified by the value of the gas that is expected to be recovered.

Horizontal drilling patterns have been tried in order to extend the amount of coal seam exposed to a drill bore for gas extraction. However, horizontal drilling patterns require complex and expensive drilling equipment, for example, for tracking location of the drilling bit and directionally drilling drainage patterns. Consequently, drilling horizontal patterns is expensive and the cost must be justified by the value of the gas that will be recovered.

In many instances it is necessary to enlarge a well bore that has a tubing residing therein. The manner in which underreamer tools for enlarging a well bore are conventional configured does not allow the underreamer tool to be used in a well bore that has a tubing.

SUMMARY

The present disclosure is directed to systems, apparatus and methods for enlarging a well bore, and use of such systems, apparatus and methods in accessing a subterranean zone with a well bore by facilitating collapse of the subterranean zone into the well bore. The well bore may be provided with a tubing string through which fluids from the subterranean zone can be withdrawn.

One illustrative implementation of the invention includes a method of accessing a subterranean zone from the surface. In the method, a well bore is formed extending from a terranean surface into the subterranean zone. A tubing string is provided within the well bore. The well bore is enlarged to a dimension selected to collapse at least a portion of the subterranean zone about the tubing. The tubing may be used, thereafter, in withdrawing fluids from the subterranean zone.

In some implementations, the method can further include perforating the tubing string while the tubing string is within the well bore. Pressure of fluids within the well bore can be reduced to facilitate collapse of at least a portion of the subterranean zone about the well bore. In some instances pressure can be reduced from an overbalanced condition to an underbalanced condition. The method can be applied to a subterranean zone that includes a coal seam. In some instances, forming a well bore can include forming a first well bore extending from the surface into the subterranean zone and forming a second substantially horizontal well bore through the first well bore. The method can further include forming a third substantially horizontal well bore through the first well bore. The first well bore may extend substantially vertical, be slanted, or otherwise. The first well bore may include a rat hole at an end thereof.

Another illustrative implementation of the invention includes a system for accessing a subterranean zone from a terranean surface. The system includes a well bore extending from the surface into the subterranean zone. A tubing string resides within the well bore. The well bore includes an enlarged cavity having a dimension selected to cause the subterranean zone to collapse inward on the tubing string.

In some implementations, the dimension of the enlarged cavity can be selected to remain substantially stable with no substantial inward collapsed when pressure within the cavity is overbalanced, and collapse when pressure within the cavity is reduced. The dimension of the enlarged cavity can be selected to collapse when the pressure within the cavity is reduced underbalanced. The dimension can include a transverse dimension of the enlarged cavity. The tubing string may be anchored in the well bore. The well bore may include a first portion extending from the surface coupled to a second portion that is oriented substantially horizontal. The first portion may extend beyond the second portion to define a sump. The first portion may be substantially vertical or slanted. The well bore can include a plurality of horizontally oriented bores in communication with a main bore, and the tubing string can include a plurality of tubing strings. The subterranean zone can include a coal seam.

Another illustrative implementation includes an underreamer for forming a cavity within a well bore. The underreamer includes a fluid motor having a first body and a second body arranged about a longitudinal axis. The first body is adapted to rotate about the longitudinal axis in relation to the second body when fluid is passed between the first and second body. The fluid motor further defines a longitudinal tubing passage adapted to allow passage of the fluid motor over a tubing string. The underreamer also includes at least one cutting arm coupled to rotate with the first body of the fluid motor. The least one cutting arm is radially extendable into engagement with an interior of the well bore in forming the cavity.

In some implementations of the illustrative underreamer the at least one cutting arm is pivotally coupled to the first body to rotate radially outward when subjected to centrifugal force. The least one cutting arm is extendable from a radially retracted position adapted to allow the underreamer to pass through the well bore.

Another illustrative implementation includes a method of forming a cavity within a well bore. In the method, an underreamer is passed over a tubing string residing in the well bore to a desired location of the cavity. Fluid is flowed through the underreamer to operate the underreamer in forming the cavity.

In some implementations of the illustrative method, operating the underreamer includes extending at least one cutting arm radially outward from a retracted to an extended position, wherein the retracted position enables the underreamer pass through the interior of the well bore and in the extended position the least one cutting arm is in engagement with an interior of the well bore. In some instances extending the least one cutting arm radially outward from the retracted position to the extended position includes rotating a portion of the underreamer so that centrifugal force acts upon the least one cutting arm to pivot the least one cutting arm radially outward. Rotating a portion of the underreamer can include flowing fluid through a positive displacement motor of the underreamer. The method can further include passing the underreamer over the tubing string to withdraw the underreamer from the well bore. Operating the underreamer in forming a cavity can include operating the underreamer in forming a cavity of a transverse dimension selected to cause the cavity to collapse.

Another illustrative implementation includes a device for perforating a tubing string residing in a well bore. The device includes a tubular housing adapted to be received within the tubing string. At least one perforating body resides in the housing and has a point adapted to pierce the tubing string. A piston is received within the housing and configured such that pressure applied to a first side of the piston causes the piston to move and in a first direction. An actuator body is received within the housing and configured for movement in the first direction with the piston. The actuator body has a sloped wedge surface adapted to wedge the least one perforating body radially outward to pierce the tubing string when the actuator body is moved in the first direction.

In some implementations of the illustrative perforating device, a spring is adapted to move the actuator body in a second direction substantially opposed the first direction. The housing may have at least one window through a lateral wall thereof, and the point of the least one perforating body extends through the least one window in piercing the tubing string. The least one perforating body can be guided by the edge surfaces of the window. The least one perforating body can include a profile adapted to interlock with a profile of the actuator body. The profile radially retains the least one perforating body in relation to the actuator body. The sloped wedge surface can include a substantially conical surface and the least one perforating body can include a plurality of perforating bodies arranged around the substantially conical surface.

Another illustrative implementation includes a method of perforating a tubing string and a well bore. In the method a perforating tool coupled to a working string is positioned in an interior of the tubing string. The perforating tool has a piston and at least one perforating body adapted to pierce the tubing string. Pressure is applied to the piston through the working string to translate the piston. The least one perforating body is radially extended outward to pierce the tubing string in response to the translation of the piston.

In some implementations of the illustrative method, extending the least one perforating body radially outward can include translating a wedge-shaped actuator in response to the translation of the piston and wedging the least one perforating body radially outward with the wedge-shaped actuator body. The method can further include retracting the least one perforating body radially inward, positioning the perforating tool and a second location within the interior of the tubing string, and repeating the steps of applying pressure to the piston and extending at least one perforating body to pierce the tubing string at the second location.

Another illustrative implementation includes a method of accessing a subterranean zone from the surface. In the method and a well bore is formed extending from the surface into the subterranean zone. A tubing string is provided within the well bore. An underreamer is passed over the tubing string to a specified location within the subterranean zone. The underreamer is operated in forming an enlarged cavity in the well bore. Pressure within the enlarged cavity is reduced to facilitate collapse of the subterranean zone about the tubing. Apertures are provided in the tubing string to allow passage of fluids into an interior of the tubing string.

The details of one or more illustrative implementations of the invention are set forth in the accompanying drawings and the description below. Other features, objects, and advantages of the invention will be apparent from the description and drawings, and from the claims.

DESCRIPTION OF DRAWINGS

Reference is now made to the following description taken in conjunction with the accompanying drawings, wherein like numerals represent like parts.

DETAILED DESCRIPTION

Figure 1:
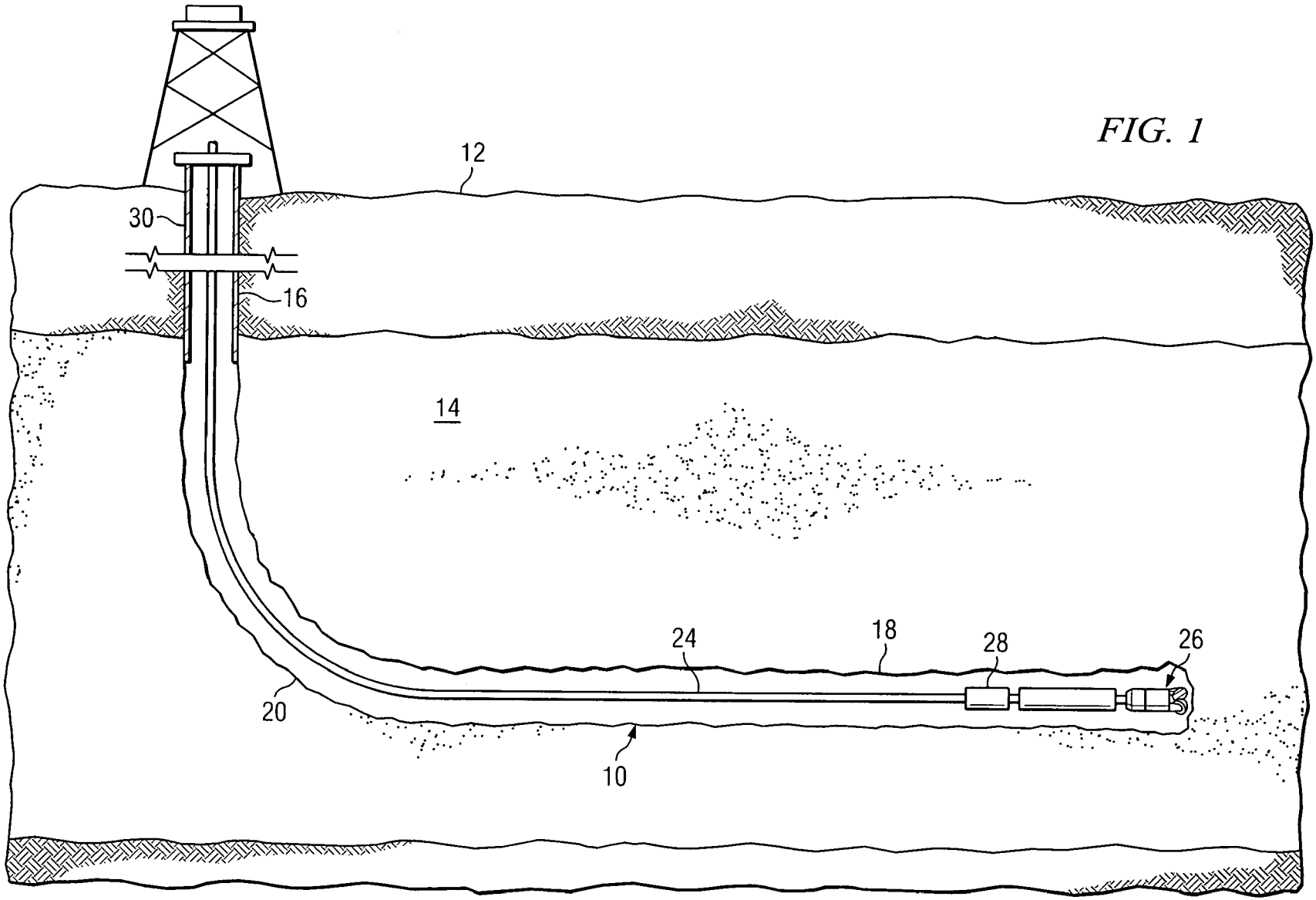
FIG. 1 is a cross-sectional view depicting the formation of an illustrative well bore in a subterranean formation in accordance with the invention.
Figure 2A:
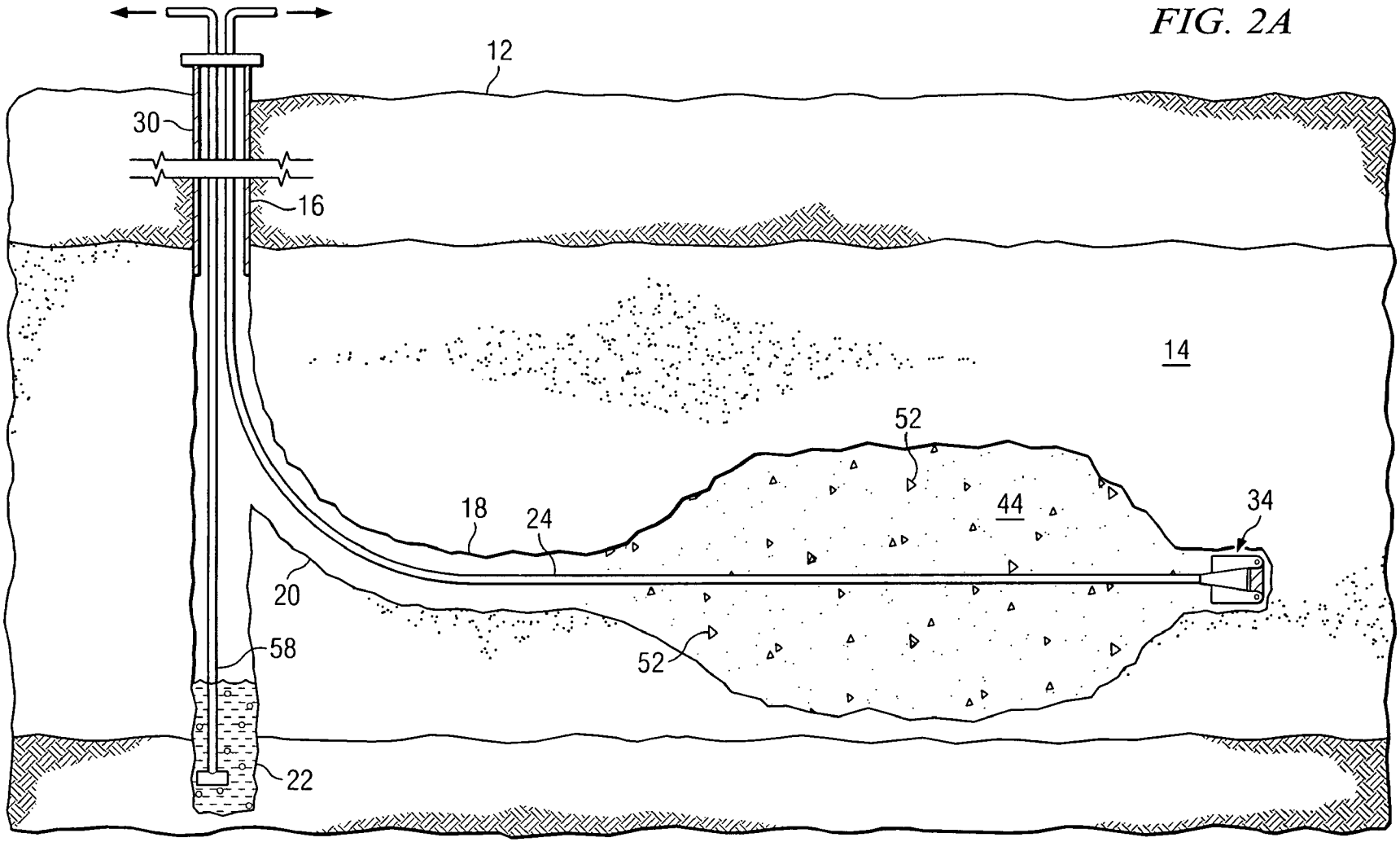
FIG. 2A is a cross-section view depicting an alternative illustrative well bore in a subterranean formation similar to the well bore of FIG. 1, but having a sump, in accordance with the invention.
Figure 2B:
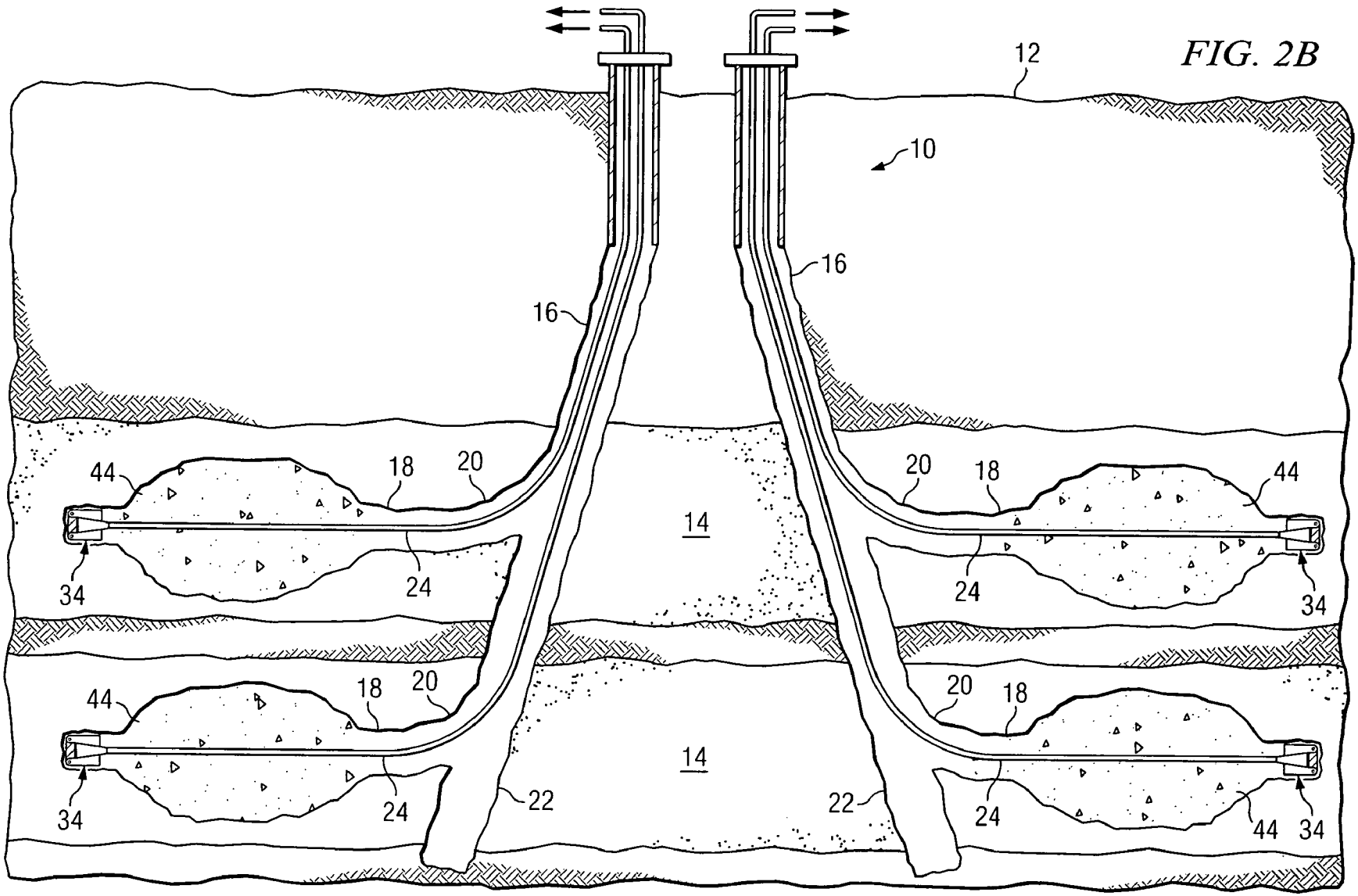
FIG. 2B is a cross-sectional view depicting alternative illustrative well bores in a subterranean formation in accordance with the invention.

Referring first to FIG. 1, an illustrative well bore 10 in accordance with the invention is drilled to extend from the terranean surface 12 to a subterranean zone 14, such as a subterranean coal seam. The well bore 10 can define a main or first portion 16 that extends from the surface 12, a second portion 18 at least partially coinciding with the subterranean zone 14 and a curved or radiused portion 20 interconnecting the portions 16 and 18. In one instance, as seen in FIGS. 2A and 2B, the first portion 16 may be drilled to extend past the curved portion 20 to define a sump 22 and/or to provide access to additional subterranean zones 14, for example, by drilling additional curved portions 20 and second portions 18. Additionally, although the first portion 16 is illustrated as being substantially vertical in FIG. 1, the first portion 16 may be formed at any angle relative to the surface 12 to accommodate surface 12 geometric characteristics and attitudes, the geometric configuration or attitude of the subterranean zone 14, or other concerns such as other nearby well bores. For example, the first portion 16 of FIG. 2B is angled to accommodate an adjacent well bore 10 drilled from the same surface area or same drilling pad.

Referring back to FIG. 1, the second portion 18 lies substantially in the plane of the subterranean zone 14. In FIG. 1, the plane of the subterranean zone 14 is illustrated substantially horizontal, thereby resulting in a substantially horizontal second portion 18. However, in an instance where the subterranean zone 14 dips up or down relative to horizontal, the second portion 18 may follow the dip. The radius of the curved portion 20 may be selected based on geometric characteristics of the subterranean zone 14 and desired trajectory of the well bore 10. The radius of curvature may also or alternatively be selected to provide reduced friction in passing a tubing or drilling string through the well bore 10. For example, a tight radius of curvature will impart higher frictional forces to a tubing or drill string than a larger radius of curvature. In one instance, the curved portion 20 is provided with a radius of between 100 and 150 feet.

The curved portion 20 and second portion 18, and in some instances the first portion 16, may be drilled using an articulated drill string 24 that includes a down-hole motor and drill bit 26. The first portion 16 may be drilled separately from the curved portion 20 and second portion 18. For example, the first portion 16 may be drilled, and then one or more the curved portions 20 and second portions 18 may be drilled through the first portion 16. A measurement while drilling (MWD) device 28 may be included in the articulated drill string 24 to track the motor and bit 26 position for use in controlling their orientation and direction. A casing 30 may be cemented into a portion of the well bore 10 subsequent to drilling, or the casing 30 may be omitted.

During the process of drilling the well bore 10, drilling fluid or "mud" is pumped down the articulated drill string 24 and circulated out of the drill string 24 in the vicinity of the motor and bit 26. The mud is used to scour the formation and remove formation cuttings produced by drilling or otherwise residing in the well bore 10. The cuttings are entrained in the drilling fluid which circulates up to the surface 12 through the annulus between the drill string 24 and the walls of the well bore 10. At the surface 12, the cuttings are removed from the drilling mud and the mud may then be recirculated. The hydrostatic pressure of the mud within the borehole exerts pressure on the interior of the well bore 10. During drilling operations, the density of mud within the well bore 10 can be selected so that the hydrostatic pressure of the drilling mud in the subterranean zone 14 is greater than the reservoir pressure, and greater than the pressure of fluids, such as coal seam gas, within the subterranean zone 14. The condition when the pressure of the drilling mud in the well bore is greater than the pressure of the formation, e.g. subterranean zone 14, is referred to as "overbalanced."

Figure 3:
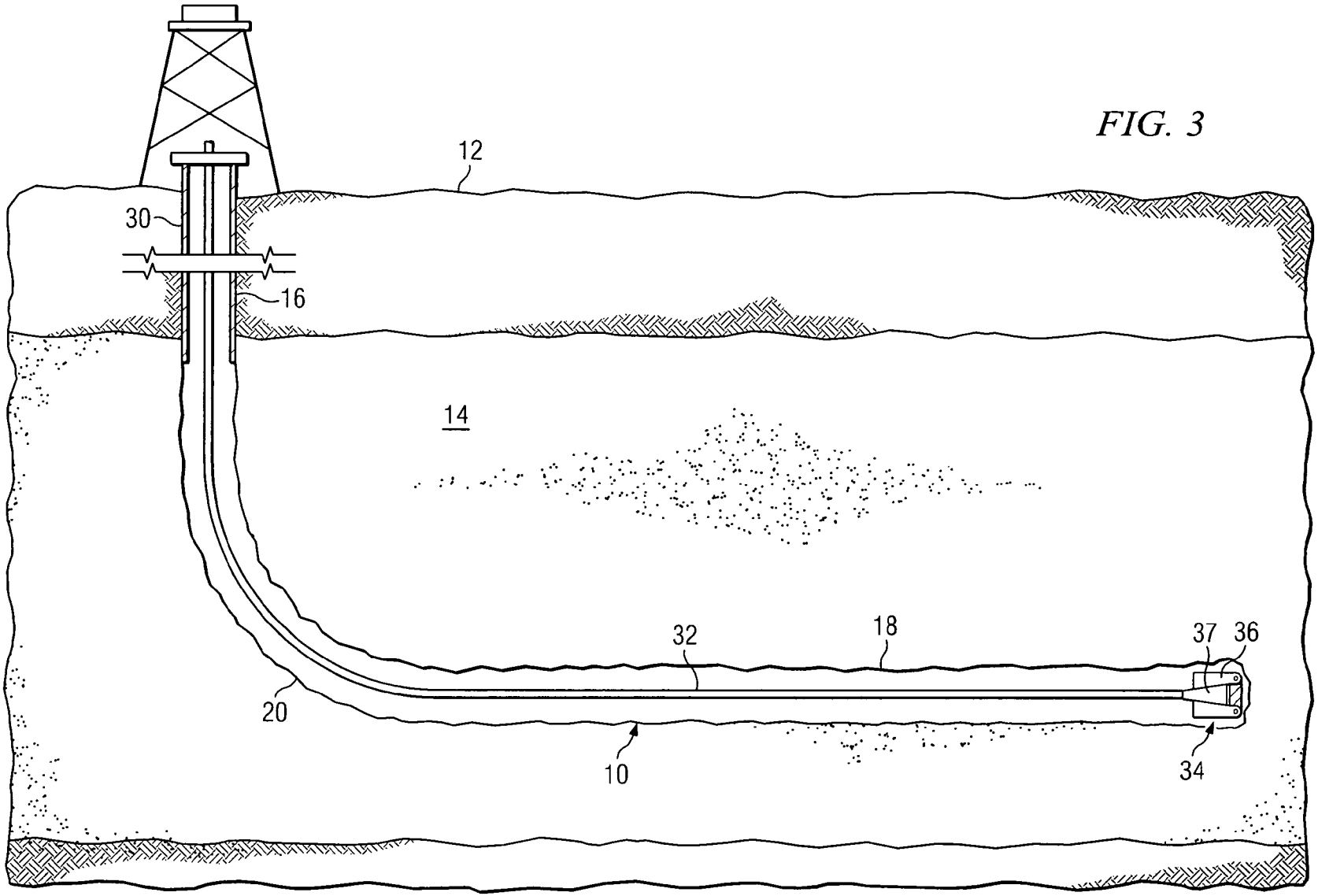
FIG. 3 is a cross-sectional view of the illustrative well bore of FIG. 1 receiving a tubing string therein in accordance with the invention.

Referring to FIG. 3, after the well bore 10 has been drilled, the articulated drill string 24 is withdrawn from the well bore 10. The drilling mud remains in the well bore 10 to maintain the well bore 10 overbalanced. A tubing string 32 is then run into and anchored in the well bore 10. In an instance where the well bore 10 includes multiple second portions 18 and curved portions 20, a tubing string 32 may be provided for each of the second portions 18 and curved portions 20 (see FIG. 2B). The tubing string 32 for each of the multiple second portions 18 and curved portions 20, however, need not be introduced concurrently. In some instances, it may be desirable to complete one or more the operations described below before providing a tubing string 32 for an additional second portion 18 and curved portion 20.

The tubing string 32 may be anchored in the well bore 10, for example, using an anchoring device 34 on the end of the string 32. The tubing string 32 defines an annulus between the tubing string 32 and the wall of the well bore 10 or the casing 30. The anchoring device 34 is adapted to traverse the annulus to grip or otherwise engage an interior surface of the well bore 10 and substantially resist movement along the longitudinal axis of the well bore 10. There are numerous devices which can be used as anchoring device 34. For example, the anchoring device 34 can be cement introduced into the annulus that, when solidified, will anchor the tubing string 32. In another instance, some of the devices that can be used as anchoring device 34 may have radially extendable members 36, such as slips or dogs, that are mechanically or hydraulic actuated to extend into engagement with and grip the interior diameter of the well bore 10 or another body affixed within the well bore 10. FIG. 3 depicts an anchoring device 34 having wedge shaped extendable members 36 that abut a wedge shaped body 37, such that movement of the tubing string 32 out of the well bore 10 tends to wedge the extendable members 36 into engagement with an interior of the well bore 10. Alternately, a small amount of cement can be placed to anchor the tubing.

Figure 4:
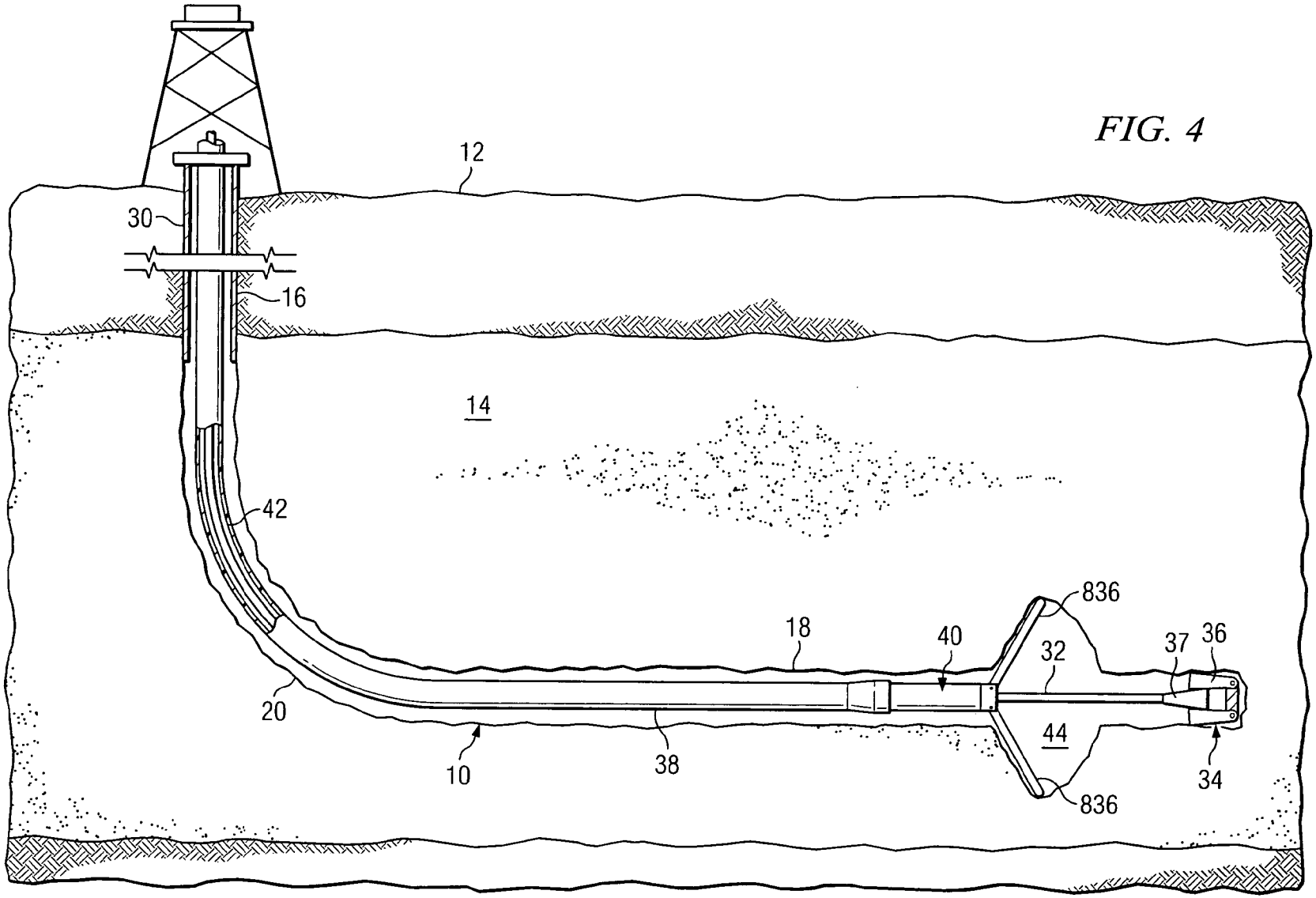
FIG. 4 is a cross-sectional view of an enlarged cavity being cut about the illustrative well bore of FIG. 1 in accordance with the invention.
Figure 8A:
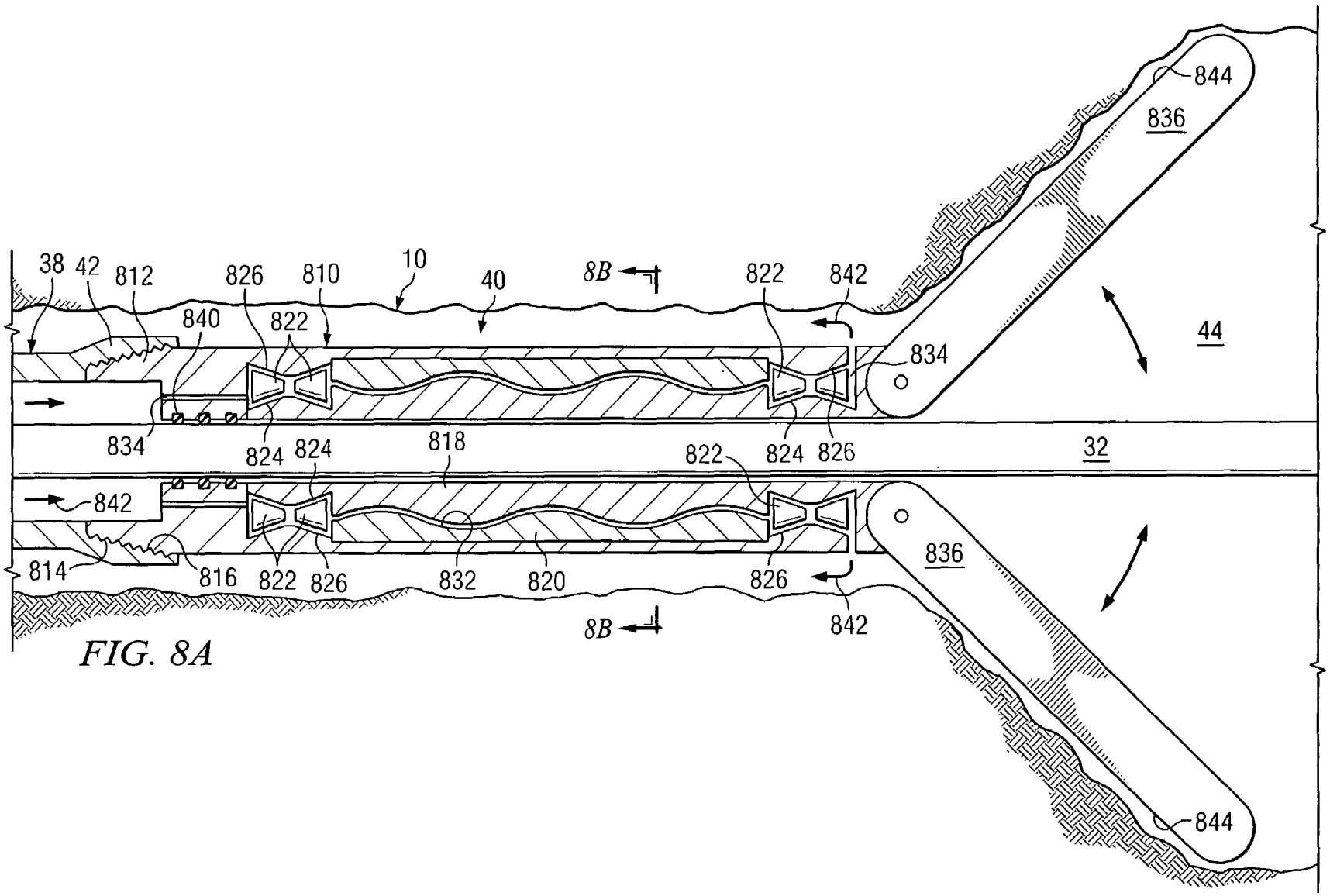
FIG. 8A is a cross-sectional view of an illustrative cavity cutting tool in accordance with the invention.
Figure 8B:
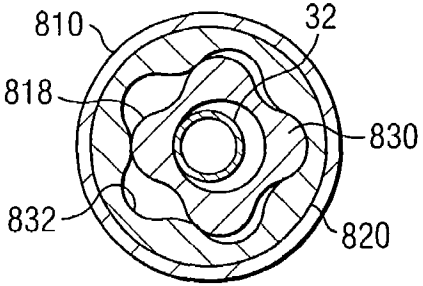
FIG. 8B is a cross-sectional view of the illustrative cavity cutting tool of FIG. 8A along section line B—B.
Figure 8C:
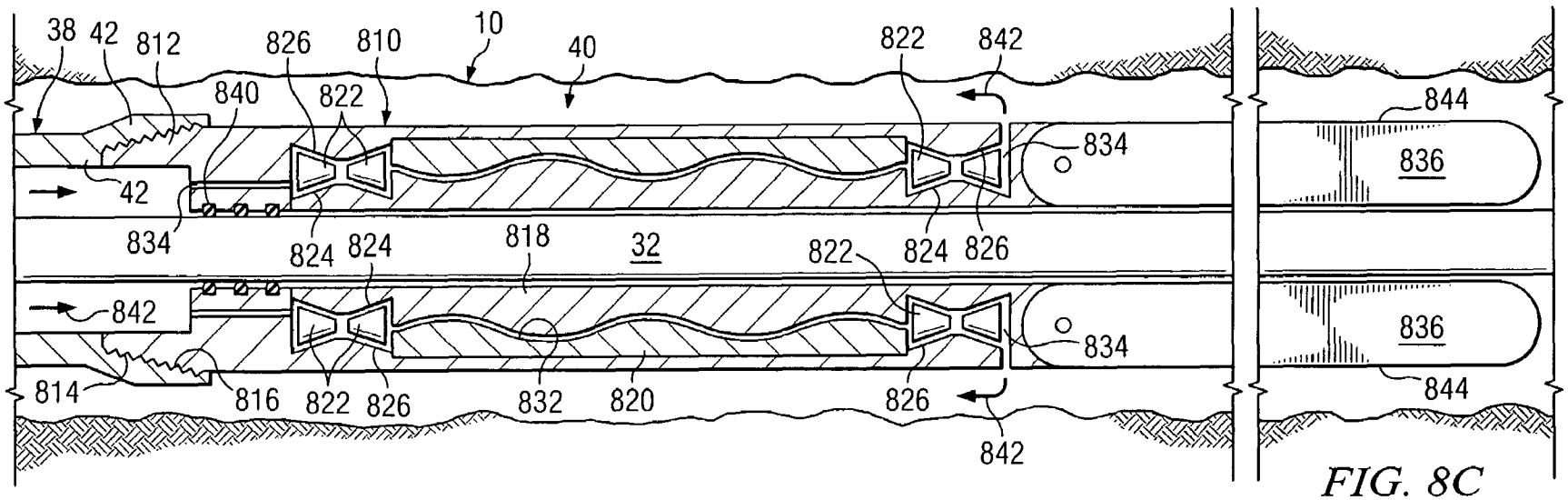
FIG. 8C is a cross-sectional view of the illustrative cavity cutting tool of FIG. 8A showing the cutting arms retracted.

Turning now to FIG. 4, a tool string 38 having an interior diameter large enough to internally receive or pass over the tubing string 32 is provided with a cavity cutting tool 40. The cavity cutting tool 40 is also adapted to internally receive the tubing string 32. The tool string 38 and cavity cutting tool 40 are introduced over the tubing string 32 and run into the well bore 10. In one instance, the tubing string 32 may be made up, at least partially, with flush joint tubing having a substantially uniform external diameter to reduce the number of step changes in exterior diameter on which the tool string 38 or cavity cutting tool 40 may hang. The cavity cutting tool 40 is a device adapted to pass through the well bore 10 to a specified location, and once in the specified location in the well bore 10, be operated to cut an enlarged cavity having a larger transverse dimension, for example diameter, than the well bore 10. While there are numerous tools for cutting a cavity within the well bore 10 that may be used in the methods discussed herein, an illustrative cavity cutting tool 40 is described in more detail below with respect to FIGS. 8A–C. The illustrative cavity cutting tool 40 depicted in FIGS. 8A–C is a mechanical cutting device using extendable cutting arms 836 to cut into the formation. Some other exemplary types of cavity cutting tools 40 can include hydraulic cutting devices, for example using pressurized fluid jets to cut into the formation, or pyrotechnic cutting devices, for example using pyrotechnics to blast a cavity in the formation.

The cavity cutting tool 40 can be positioned about the end of the well bore 10, and subsequently actuated to begin cutting an enlarged cavity 44. Thereafter, the cavity cutting tool 40 is drawn back up along the longitudinal axis of the well bore 10 to elongate the enlarged cavity 44 along the longitudinal axis of the well bore 10. However, it is with the scope of the methods described herein to begin cutting the enlarged cavity 44 at other positions within the well bore 10, as well as to begin cutting at multiple locations within the well bore 10 to create multiple discrete enlarged cavities 44 along the well bore 10.

Figure 5:
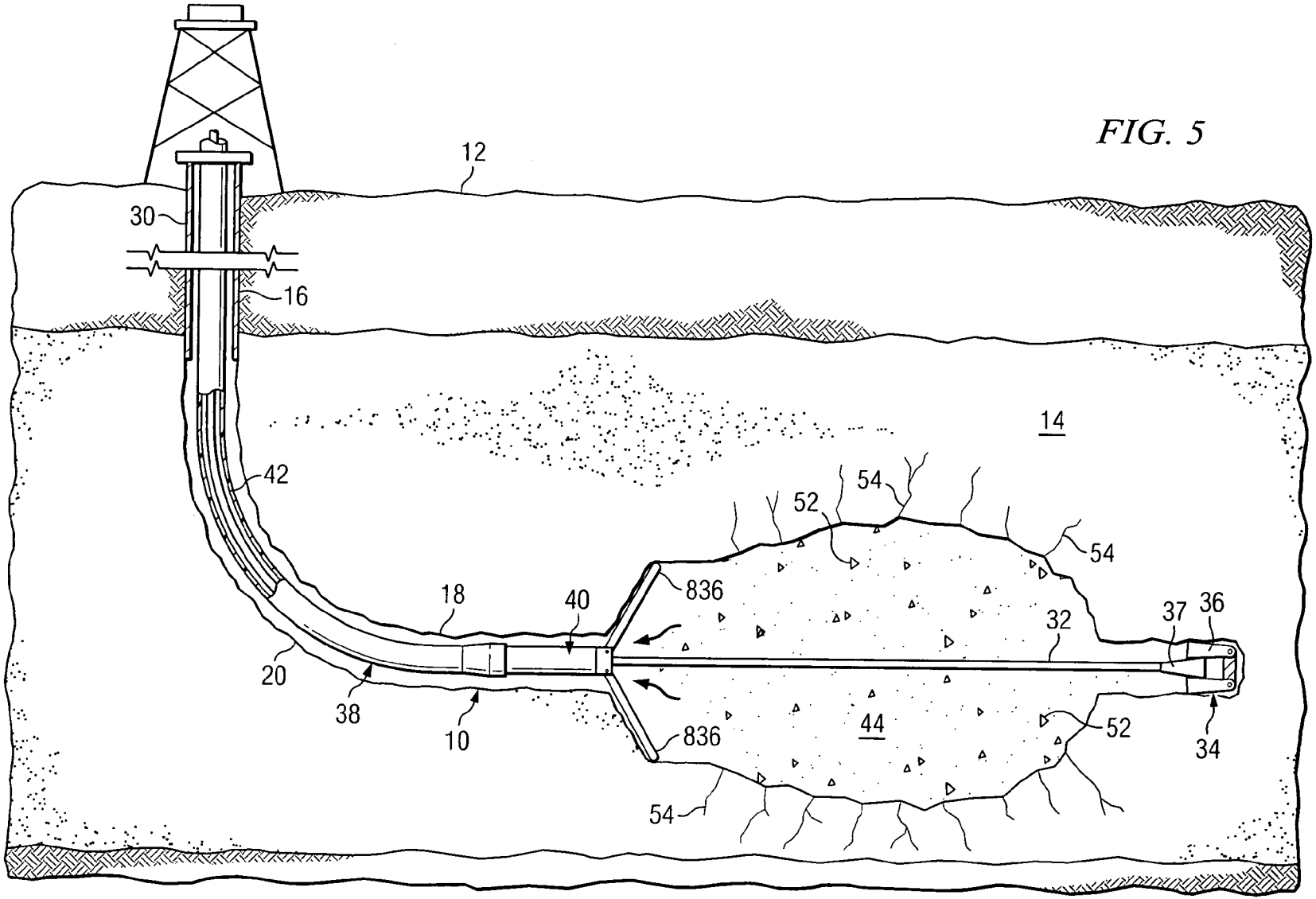
FIG. 5 is a cross-sectional view of the enlarged cavity of FIG. 4 collapsing about the tubing string in accordance with the invention.

Referring now to FIG. 5, as the enlarged cavity 44 is being cut, the well bore 10 and cavity 44 can be maintained overbalanced. The stability of the enlarged cavity 44 is dependent, in part, on its transverse dimension. Thus the geometry of the enlarged cavity 44, and particularly the transverse dimension, is selected so that in this overbalanced state, the cavity 44 remains substantially stable with little to no inward collapse. However, when the hydrostatic pressure of the mud is reduced below the in-situ rock pressure about the cavity 44 (i.e. underbalanced) the cavity 44 tends to collapse inwardly. Thus, when the cavity 44 is complete and the cavity cutting tool 40 removed from the cavity 44, the mud density and/or depth of mud within the well bore 10 can be adjusted so that the cavity 44 becomes underbalanced and collapses inwardly onto the tubing string 32. After collapse, loosely packed, and therefore high permeability, remains 52 of the subterranean zone 14 reside about the tubing string 32. Of note, the enlarged cavity 44 may collapse without substantial portions of the well bore 10 collapsing.

Although the drilling operations and formation of the enlarged cavity 44 are described above as being performed overbalanced, the drilling operations and/or formation of the enlarged cavity 44 need not be performed overbalanced. For example, the drilling operations and/or formation of the enlarged cavity 44 can be performed when the pressure in the well bore 10 is balanced or underbalanced. To wit, the dimension, such as the transverse dimension, of the cavity 44 can be selected such that the cavity 44 remains substantially stable with little to no inward collapse at the balanced or underbalanced condition, but tends to collapse when the pressure is reduced. Further, the concepts described herein can be used in forming a well bore 10 with an enlarged cavity 44 without using a pressure change to facilitate collapse of the enlarged cavity 44. For example, the dimension of the cavity 44, such as the transverse dimension, can be selected to collapse without further influence from outside factors such as the reduction in pressure in the cavity 44.

Collapsing the enlarged cavity 44 not only breaks up the material of the subterranean zone 14 surrounding the enlarged cavity 44 thereby releasing the fluids residing therein, it also increases the exposed surface area through which fluids can be withdrawn from the subterranean zone 14 and increases the reach into the subterranean zone 14 from which fluids can be withdrawn. Increasing the exposed surface area through which fluids can be withdrawn increases the amount of fluids and the rate at which fluids can be withdrawn. The collapsed enlarged cavity 44 has a larger transverse dimension than the well bore 10, and a larger transverse dimension than the enlarged cavity 44, because the material surrounding the enlarged cavity 44 has collapsed inward. The larger transverse dimension improves the depth (i.e. reach) into the subterranean zone 14 from which fluids can be withdrawn without the fluids having to migrate through material of the subterranean zone 14. Additionally, the collapse is likely to induce cracks or fractures 54 that extend from the interior of the collapsed cavity 44 even deeper into the subterranean zone 14. The fractures 54 form pathways through which fluids residing in the subterranean zone 14 can travel into the collapsed cavity 44 and be recovered and enable conductivity beyond the skin of the bore (10) plugged or damaged by forming the cavity 44. Accordingly, by collapsing the enlarged cavity 44, more of the subterranean zone can be produced than with a bare well bore 10 or well bore 10 and enlarged cavity 44. Of note, while FIG. 6A depicts a total collapse of the cavity 44, a collapse of just a portion of the cavity 44 can yield similar improvements in accessing the subterranean zone 14.

Figure 6A:
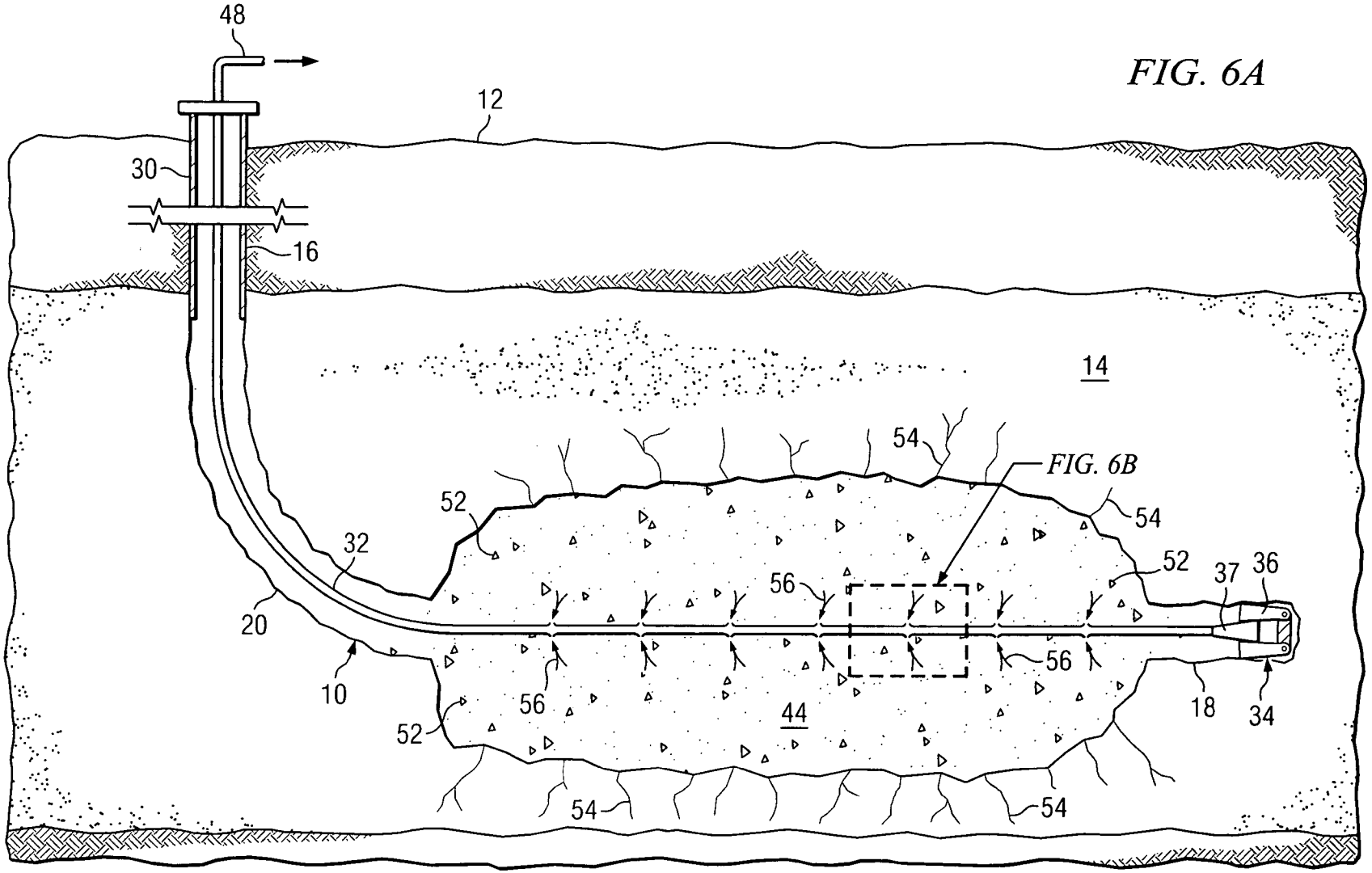
FIG. 6A is a cross-sectional view of the enlarged cavity of FIG. 4 collapsed about the tubing string and fluids being produced through the tubing string in accordance with the invention.
Figure 6B:
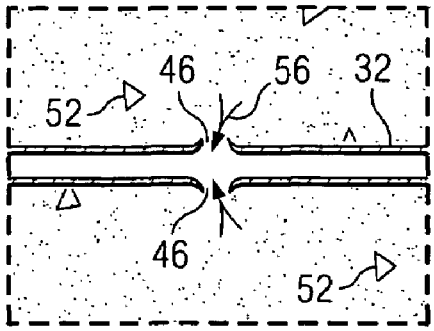
FIG. 6B is a detail cross-sectional view of illustrative apertures in the tubing string in accordance with the invention.
Figure 9A:
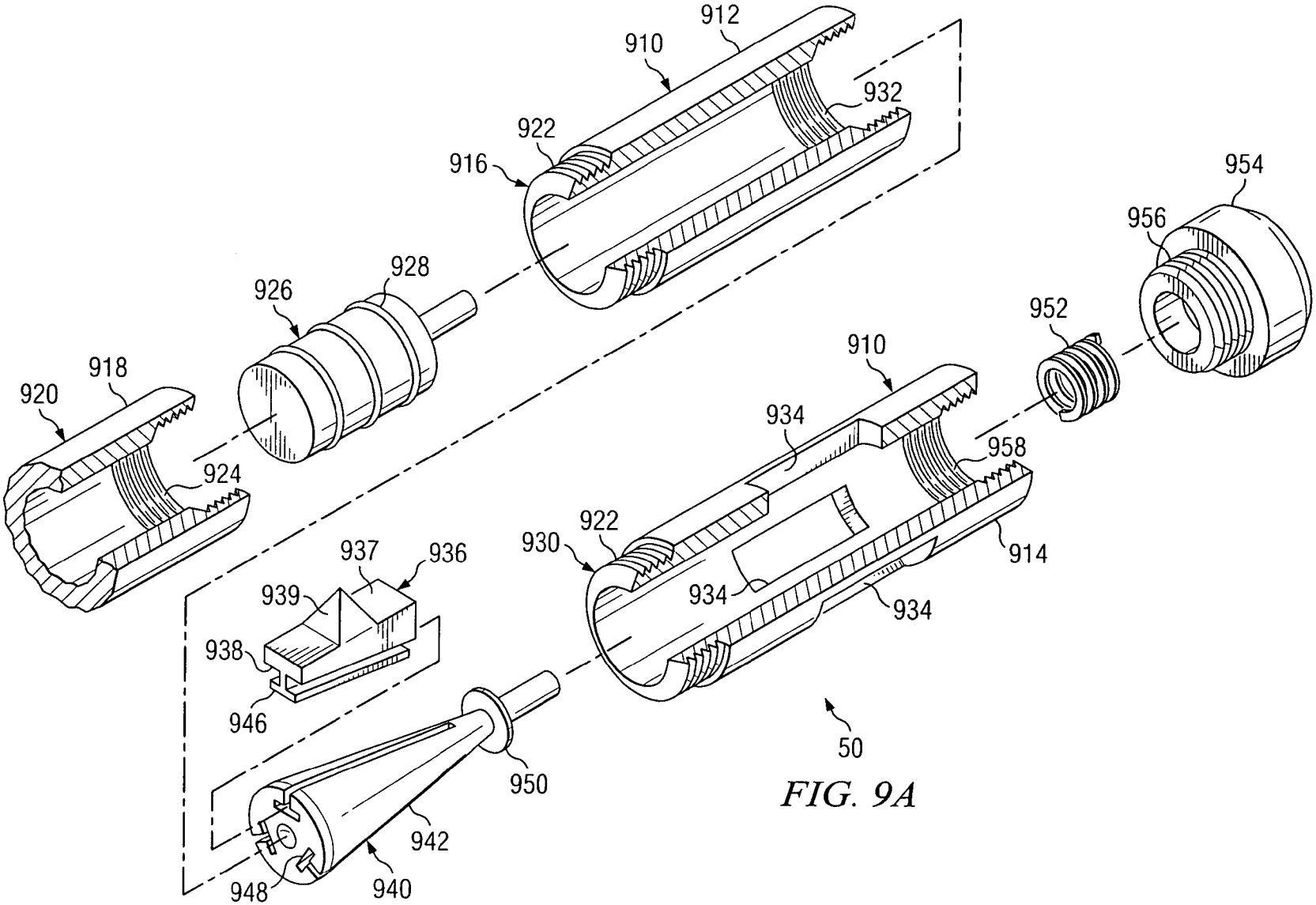
FIG. 9A is a exploded view of an illustrative tubing perforating tool in accordance with the invention.

Referring to FIGS. 6A and 6B, the tubing string 32 may include a portion or portions that are slotted, perforated or otherwise screened or the tubing string 32 may be perforated once in the well bore 10 to define apertures 46 (FIG. 6B) that allow fluids, such as coal seam gas, from the subterranean zone 14 to flow into an interior of the tubing string 32 and to the surface. While there are numerous different tools that may be used to perforate the tubing string 32 according to the methods discussed herein, an illustrative tubing perforating tool 50 is described in more detail below with respect to FIG. 9. The apertures 46 can be sized to substantially prevent passage of particulate into the interior of the tubing string 32, for example particulate which may clog the interior of the tubing string 32.

The subterranean zone 14 can be produced through the tubing string 32 by withdrawing fluids 56 from the subterranean zone 14, through the apertures 46 and up through the tubing string 32. The well bore 10 may be shut in, and the tubing string 32 connected to a surface production pipe 48. Thereafter, the subterranean zone 14 can be produced by withdrawing fluids through the interior of the tubing string 32 to the surface production pipe 48. In an implementation that includes a sump 22 (FIG. 2A), liquids from the subterranean zone 14, for example water from the coal seam and other liquids, will collect in the sump 22. As a result, the liquids tend not to form a hydrostatic head within the tubing string 32 that may hinder production of gases, such as coal seam gas, from the subterranean zone 14. A pump string 58 can be introduced through the well bore 10, adjacent the tubing string 32, and into the sump 22 to withdraw liquids accumulated in the sump 22. Alternately, the pump string 58 can be introduced through a second, vertical well bore (not specifically shown) that is intersected by the well bore 10, for example, at a cavity formed in the second, vertical well bore.

Figure 7:
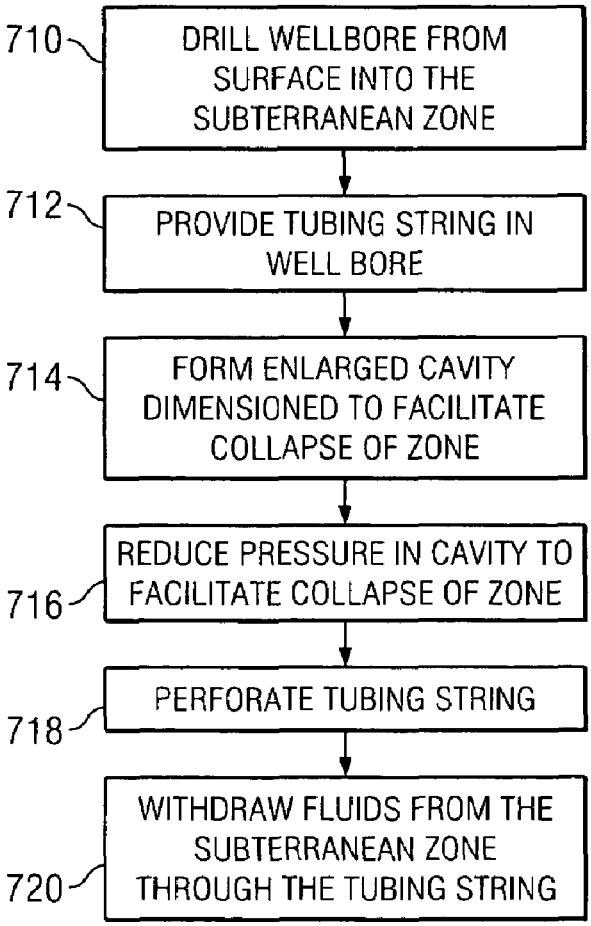
FIG. 7 is a flow diagram of an illustrative method of completing a well in accordance with the invention.

FIG. 7 is a flow diagram illustrating an illustrative method for producing gas from a subterranean zone. The illustrative method begins at block 710 where a well bore is drilled from the surface into the subterranean zone. As is discussed above, the well bore can take various forms. For example, the well bore may be an articulated well bore having a first portion that extends from the surface, a second portion at least partially coinciding with the subterranean zone and a curved or radiused portion interconnecting the first and second portion. The first portion of the well bore may be drilled to extend past the curved portion to define a sump and/or to provide access to additional subterranean zones, such as, by drilling additional curved portions and second portions (see for example, FIGS. 2A and 2B). The first portion of the well bore can be formed at an angle, for example as a slant well, or with a portion at an angle, for example having a vertical entry well coupled to a slant well (see for example, FIG. 2A). The well bore can be drilled in an overbalanced condition so that the pressure of fluids, such as drilling mud, within the well bore is greater than the pressure of fluids within the subterranean zone surrounding the well bore.

At block 712, a tubing string is provided in the well bore. The tubing string may be run into the well bore and thereafter anchored, as is discussed above, to prevent movement of the tubing string along the longitudinal axis of the well bore.

At block 714, the well bore is enlarged to form an enlarged cavity. The dimensions of the enlarged cavity, such as the transverse dimension, is selected to facilitate collapse of the subterranean formation into the well bore and onto the tubing string. As is discussed above, the enlarged cavity may be formed with a cavity cutting tool that is introduced over the tubing string and run into the well bore. Once at the desired location to begin the formation of the enlarged cavity, for example at the end of the well bore, the cavity cutting tool is activated to begin cutting the enlarged cavity. While the cavity cutting tool is being operated to cut the subterranean zone, it may be drawn back up the longitudinal axis of the well bore to elongate the enlarged cavity. The cavity cutting tool can be operated at multiple locations within the well bore to create multiple discrete enlarged cavities or can be operated to create a single elongate enlarged cavity. As the enlarged cavity is being cut, the well bore and cavity can be maintained overbalanced. Alternately, pressure can be reduced a intermediate amount or reduced to a balanced or underbalanced condition while cutting the cavity, thereby aiding cutting. Pressure maintained within the cavity, whether overbalanced or not, may provide support to prevent collapse of the cavity into the well bore during the formation of the enlarged cavity. Thereafter the cavity cutting tool may be withdrawn.

At block 716, the pressure within the cavity is reduced. The reduction in pressure reduces the support provided by the pressure to the interior of the enlarged cavity, and thus facilitates the cavity's collapse inward into the well bore. In an instance where the pressure within the well bore is overbalanced, the pressure may be reduced underbalanced. In an instance where the pressure within the well bore is balanced or underbalanced, the pressure may be reduced further. After collapse, loosely packed and therefore highly permeable remains of the subterranean zone reside about the tubing string.

At block 718, if the tubing string has not already been provided with slots or apertures, the tubing string may be perforated. In one instance, the tubing string is perforated by providing a perforating tool introduced through the interior of the tubing string. The perforating tool can be positioned within the interior of the tubing string and actuated to perforate the tubing string. Thereafter, the perforating tool can be repositioned and actuated to begin perforating the tubing string at a different location or may be withdrawn.

Finally, at block 718, fluids, such as coal seam gas, can be withdrawn from the subterranean zone through the tubing string. The fluids can flow into the tubing string through the apertures, and up the tubing string to the surface. In one instance, the tubing string can be coupled to a production pipeline and gases withdrawn from the subterranean zone through the interior of the tubing string. In an instance where the well bore includes a sump, liquids, such as water from the subterranean zone, will travel down the well bore and collect in the sump. Thereafter, the liquids in the sump may be periodically withdrawn. Allowing the liquids to collect in the sump reduces the amount of liquids in the fluids produced to the surface, and thus, the likelihood that the liquids will form a hydraulic head within the tubing string and hinder production of gases to the surface.

Of note, in an instance where the well bore has additional curved portions and second portions, for example for accessing additional subterranean zones, the operations at blocks 712 through 720 can be repeated for each additional curved portion and second portion. Multiple operations at blocks 712 through 720 for different curved portions and second portions may occur concurrently, or operations at blocks 712 through 720 for different curved portions and second portions may be performed alone.

FIG. 8A depicts an illustrative cavity cutting tool 40 constructed in accordance with the invention. The illustrative cavity cutting tool 40 includes a tubular main housing 810. One end of the main housing 810 defines a tool string engaging portion 812 adapted to couple the cavity cutting tool 40 to the remainder of the tool string 38. In the illustrative cavity cutting tool 40 of FIG. 8, the tool string engaging portion 812 has threads 814 adapted to engage mating threads 814 of a tubing 42 of the tool string 38. The main housing 810 defines an interior cavity that receives an inner body 818 and an outer body 820. Together, the inner body 818 and outer body 820 define the rotor and stator, respectively, of a positive displacement motor. The inner body 818 is tubular to enable the cavity cutting tool 40 to pass over the tubing string 32. The inner body 818 is carried within the housing 810 on bearings 822 positioned between the inner body 818 and the housing 810 that enable the inner body 818 to rotate relative to the outer body 820 about a longitudinal axis of the cavity cutting tool 40. The bearings 822 can also be configured to axially retain the inner body 818 relative to the outer body 820. In the illustrative cavity cutting tool 40 of FIG. 8, the bearings 822 are configured to axially retain the inner body 818 by being conical and bearing against corresponding conical races 824, 826 defined in both the inner body 818 and housing 810 respectively. The bearings 822 are provided in pairs, with one bearing 822 in each pair oriented to support against axial movement of the inner body 818 in one direction and the other bearing 822 in each pair oriented to support axial movement of the inner body 818 in an opposing direction.

As is best seen in FIG. 8B, the inner body 818 has a plurality of radial lobes 830 (four shown in FIG. 8B) that extend helically along its length. The outer body 820 has a greater number cavities 832 (five shown in FIG. 8B) in its interior that extend helically along its length and that are adapted to receive the radial lobes 830. Passage of fluid between the inner body 818 and the outer body 820 causes the inner body 818 to walk about the interior perimeter of the outer body 820, sequentially placing lobes 830 into cavities 832, to rotate the inner body 818 as a rotor within the outer body 820 acting as a stator. The outer body 820 is affixed to the main housing 810, so that the inner body 818 rotates relative to the main housing 810. A fluid passage 834 (FIG. 8A) directs fluid 842 received from the tool string 38 in the interior of housing 810 through the inner body 818 and outer body 820 and out of the base of the housing 810. One or more seals 840 may be positioned to seal against passage of fluid through the annulus between the tubing string 32 and the interior of the inner body 818.

Referring to FIGS. 8A–8C, a plurality of cutting arms 836 are joined at their ends to the inner body 818 to pivot radially outward. Accordingly, when the inner body 818 is rotated by passing fluids between the inner body 818 and the outer body 820, centrifugal forces cause the cutting arms 836 to the extend outward, bear on the interior wall of the well bore 10, and cut into the walls of a well bore 10. When the inner body 818 is stationary, the cutting arms 836 hang substantially in-line with the remainder of the cavity cutting tool 40 (FIG. 8C). The cutting arms 836 are configured so that when hanging in-line with the remainder of the cavity cutting tool 40, they do not extend substantially past the outer diameter of cavity cutting tool 40. As such, this allows the cavity cutting tool 40 to pass through the interior of the well bore 10. The cutting arms 836 may have a hardened and sharpened outer edge 844 for removing material in forming the cavity 44. The length of the cutting arms 836 dictates the transverse dimension of the cavity 44 cut by the cavity cutting tool 40. For example, longer cutting arms 836 will cut a larger diameter cavity 44 than shorter cutting arms 836.

In operation, the illustrative cavity cutting tool 40 is coupled to the tool string 38. The tool string 38, including the cavity cutting tool 40, is received over the tubing string 32 and lowered into the well bore 10. When the cavity cutting tool 40 reaches the point in the well bore 10 at which it is desired to begin the cavity 44, fluid, for example drilling mud, is pumped down the tool string 38 into the cavity cutting tool 40. The fluid passes between the inner body 818 and the outer body 820 to cause the inner body 818 to begin rotating. The fluid exits the cavity cutting tool 40 at the base of the tool and is recirculated up through the annulus between the tool string 38 and the interior of the well bore 10. Centrifugal force acts upon the cutting arms 836 causing the cutting arms 836 to pivot radially outward into contact with the interior of the well bore 10. Continued rotation of the inner body 818 causes the cutting arms 836 to remove material from the interior of the well bore 10 thereby forming the cavity 44. The cavity cutting tool 40 can be maintained in place within the well bore 10 until the cutting arms 836 have removed enough material to fully extend. Thereafter the cavity cutting tool 40 can be drawn up hole through the well bore 10, to elongate the cavity 44. Of note, during operation the cutting arms 836 may not extend to be substantially perpendicular to the longitudinal axis of the cavity cutting tool 40, but rather may reside at an acute angle to the longitudinal axis, when fully extended. When the desired length of the cavity 44 is achieved, fluid circulation through the cavity cutting tool 40 can be ceased. Ceasing the fluid circulation through the cavity tool 40 stops rotation of the inner body 818 and allows the cutting arms 836 to retract in-line with remainder of the cavity cutting tool 40. Thereafter, the tool string 38 can be withdrawn from the well bore 10.

Although described above as having the outer body 820 fixed in relation to the tool string 38 and having the inner body 818 rotate in relation to the tool string 38, the outer body 820 and inner body 818 could be configured differently such that the inner body 818 is fixed in relation to the tool string 38 (operating as a stator) and the outer body 820 rotates in relation to the tool string 38 (operating as a rotor). In such different configuration, the cutting arms 836 would then be attached to the outer body 820. Further, the inner body 818 and the outer body 820 need not be the helically lobed inner body 818 and corresponding outer body 820 described above. The inner body 818 and the outer body 820 can be numerous other types of devices able to translate fluid flow into rotational movement, such as a finned turbine and turbine housing or a Archimedes screw and screw housing.

FIG. 9 depicts an exploded view of an illustrative perforating tool 50 constructed in accordance with the invention. The illustrative perforating tool 50 includes a housing 910 that may be formed in two connectable portions, an upper housing portion 912 and a lower housing portion 914. The housing 910 is sized to pass through the interior of a tubing string, such as tubing string 32 (FIG. 6A), that is received in a well bore and spaced from an interior wall thereof. The upper housing portion 912 includes a tubing string engaging portion 916 adapted to join the perforating tool 50 to a tubing 918 of a tubing string 920. The tubing 918 may be rigid tubing or coiled tubing. In the illustrative perforating tool 50 of FIG. 9, the tool string engaging portion 916 has threads 922 adapted to engage mating threads 924 of the tubing 918. The upper housing portion 912 is tubular and adapted to slidingly receive a substantially cylindrical piston 926 therein. The piston 926 may include seals 928 adapted to seal the piston 926 with the interior wall of the upper housing portion 912. Fluid pressure from within the tubing string 920 acts upon the piston 926 causing the piston to move axially through the upper housing portion 912 towards the lower housing portion 914.

Figures 9B, 9C:
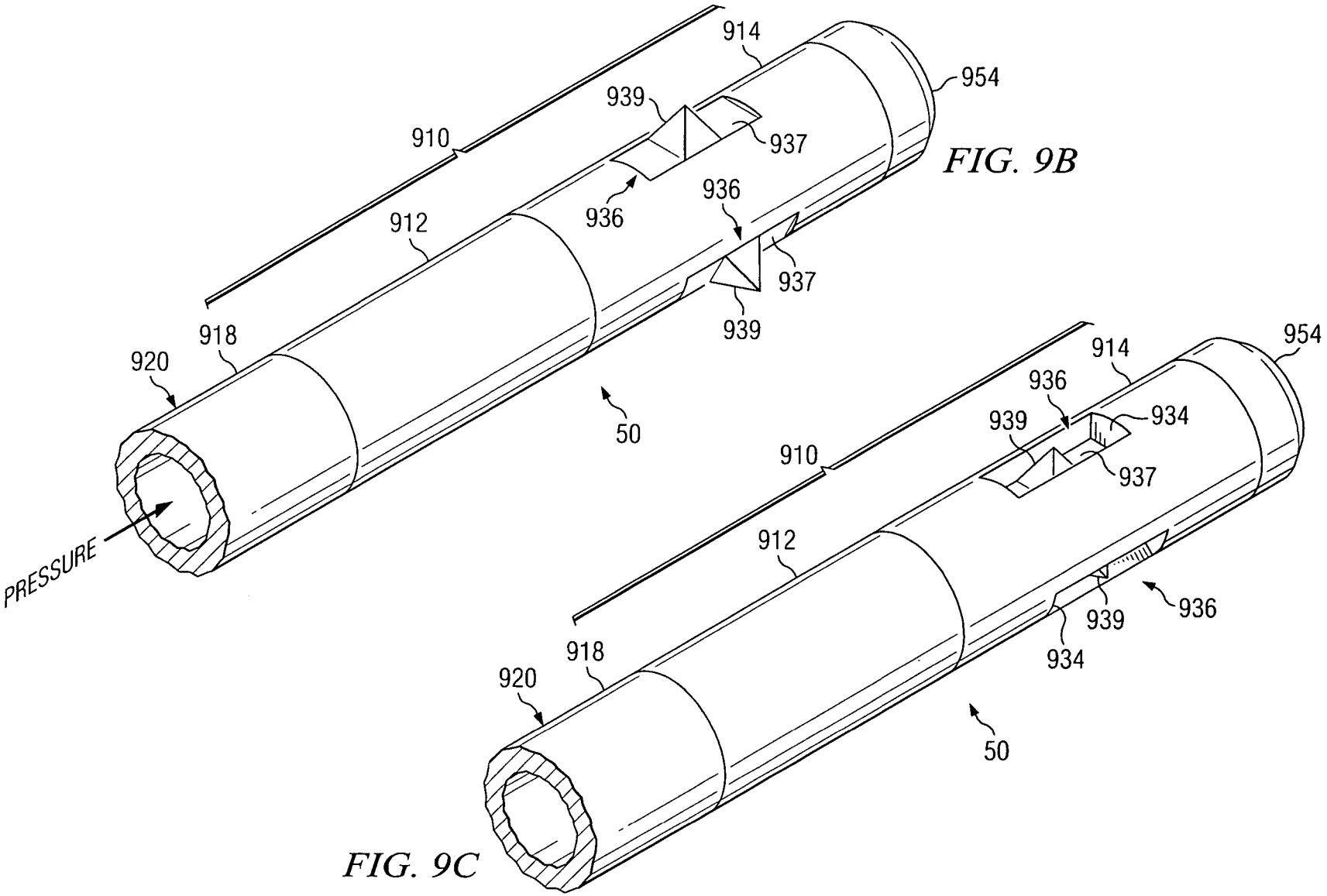
FIG. 9B is a perspective view of the illustrative tubing perforating tool of FIG. 9A depicted with the perforating wedges radially extended.
FIG. 9C is a perspective view of the illustrative tubing perforating tool of FIG. 9A depicted with the perforating wedges radially retracted.

The lower housing portion 914 is adapted to join with the upper housing portion 912, for example by including threads 930 adapted to engage mating threads 932 on the upper housing portion 912. The lower housing portion 914 is tubular and includes a plurality of lateral windows 934. The illustrative lower housing 914 includes three equally spaced windows 934; however, it is anticipated that other numbers of windows 934 could be provided. The windows 934 allow an equal number of perforating wedges 936 to protrude therethrough, with a perforating wedge 936 in each window 934 (FIG. 9B). The perforating wedges 936 are captured between the upper and lower edge surfaces of the windows 934, as well as, the lateral edge surfaces of the windows 934, so that the perforating wedges 936 are guided by the edge surfaces to move radially, but not substantially axially or circumferentially relative to the lower housing 914.

Each perforating wedge 936 has an outward facing surface 937 and an inward facing surface 938. The inward facing surface 938 is slanted relative to the outward facing surface 937, and includes a T-shaped protrusion 946. The outward facing surface 937 has one or more pyramid or conical perforating points 939 adapted to pierce a tubing, such as that of tubing string 32. The illustrative perforating tool 50 of FIG. 9A includes perforating wedges 936 with one perforating point 939 on each outward facing surface 937. The lower housing portion 914 internally receives an actuator body 940 to be slidingly received within the lower housing portion 914. The actuator body 940 includes a conical portion 942 that generally corresponds in slope to the inward facing surface 938, increasing in diameter from the middle of the actuator body 940 towards an upper end. T-shaped protrusion 946 of the perforating wedge 936 is received in a corresponding T-shaped slot 948 in the actuator body 940. The T-shaped protrusion 946 and T-shaped slot 948 interlock to retain the perforating wedge 936 adjacent the actuator body 940, but allow the perforating wedge 936 to move longitudinally along the surface of the conical portion 942. The conical portion 942 and inward facing surface 938 cooperate to wedge the perforating wedges 936 radially outward as the actuating body 940 is moved downward.

The actuator body 940 reacts against a spring 952, for example with a radially extending flange 950 proximate the end of the conical portion 942. The spring 952, in turn, reacts against a cap 954 joined to an end of the lower housing 914. The cap 954 can include threads 956 that are received in mating threads 958 on the lower housing 914. The spring 952 operates to bias the actuator body 940 upward. The flange 950 operates to limit upward movement of the actuator body 940 by abutting the perforating wedges 936.

Accordingly, in operation, the illustrative perforating tool 50 is positioned within a tubing such as the tubing string 32 (FIG. 6A) at a desired location for perforating the tubing. Thereafter, the illustrative perforating tool 50 is actuated to extend the perforating wedges 936 by supplying pressure through the tubing string 920. Such pressure acts upon the piston 926 which, in turn, acts upon the actuator body 940, driving both downward within the housing 910. Downward movement of the actuator body 940 wedges the perforating wedges 936 radially outward from the housing 910, thereby forcing the perforating points 939 to pierce through the tubing (e.g. tubing string 32). Releasing pressure in the interior of the tubing string 920 allows the piston 926 and actuator body 940, biased upward by the spring 952, to move upward and enable the perforating wedges 936 to retract. The illustrative perforating tool 50 may then be repositioned at another location within the tubing, and the perforating repeated, or the illustrative perforating tool 50 may be withdrawn from the tubing.

As is best seen in FIG. 6B, because the illustrative perforating tool 50 perforates the tubing string 32 from within using points 939, the resulting apertures 46 are conical having a smaller diameter at the outer diameter of the tubing string 32 than at the inner diameter. The apertures 46 operate to prevent passage of particulate into the interior of the tubing string 32. The apertures 46 resist bridging or becoming clogged by any particulate, because their smallest diameter is on the exterior of the aperture 46.

A number of embodiments of the invention have been described. Nevertheless, it will be understood that various modifications may be made without departing from the spirit and scope of the invention. For example, while the concepts described herein are described with reference to a coal seam, it should be understood that the concepts are applicable to other types of subterranean fluid bearing formations. Accordingly, other embodiments are within the scope of the following claims.

What is claimed is:

1. An underreamer for forming a cavity within a well bore, comprising:

a fluid motor having a first body and a second body arranged about a longitudinal axis, the first body adapted to rotate about the longitudinal axis in relation to the second body when fluid is passed between the first and second bodies, the fluid motor further defining a longitudinal tubing passage adapted to allow passage of the fluid motor over a tubing string; and at least one cutting arm coupled to rotate with the first body, the at least one cutting arm radially extendable into engagement with an interior of the well bore to form the cavity.

2. The underreamer of claim 1 wherein the at least one cutting arm is pivotally coupled to the first body to rotate radially outward.

3. The underreamer of claim 2 wherein the at least one cutting arm is rotated radially outward by centrifugal force.

4. The underreamer of claim 1 wherein the at least one cutting arm is radially extendable from a retracted position adapted to allow the underreamer pass through the well bore.

5. The underreamer of claim 1 further comprising a seal in the longitudinal tubing passage adapted to substantially seal against passage of fluid between the tubing string and the interior of the tubing passage.

6. The underreamer of claim 1 wherein the first body comprises a plurality of lobes extending helically along a length of the first body; and wherein the second body comprises a plurality of cavities extending helically along a length of the second body and adapted to receive the lobes, the number of cavities exceeding the number of lobes.

7. The underreamer of claim 1 wherein the second body is adapted to couple to a tubing, the tubing comprising at least one of rigid tubing or coiled tubing.

8. A method of forming a cavity within a well bore, comprising:

passing an underreamer over a tubing string residing in the well bore to a desired location of the cavity; and flowing fluid through the underreamer to operate the underreamer in forming the cavity.

9. The method of claim 8 wherein flowing fluid through the underreamer to operate the underreamer in forming the cavity comprises:

extending at least one cutting arm radially outward from a retracted to an extended position, the at least one cutting arm in the retracted position enabling the underreamer to pass through the interior of the well bore and the at least one cutting arm in the extended position being in engagement with an interior of the well bore.

10. The method of claim 9 wherein the at least one cutting arm is pivotally coupled to a portion of the underreamer; and wherein extending at least one cutting arm radially outward from the retracted position to the extended position comprises rotating the portion of the underreamer so that centrifugal force acts upon the at least one cutting arm to pivot the at least one cutting arm radially outward.

11. The method of claim 10 wherein rotating the portion of the underreamer comprises flowing fluid through a positive displacement motor of the underreamer.

12. The method of claim 9 further comprising passing the underreamer over the tubing string to withdraw the underreamer from the well bore.

13. The method of claim 9 wherein flowing fluid through the underreamer to operate the underreamer in forming the cavity comprises operating the underreamer in forming the cavity of a transverse dimension selected to cause the cavity to collapse.

14. The method of claim 13 further comprising pressurizing an interior of the well bore and cavity overbalanced concurrently with operating the underreamer in forming the cavity.

15. The method of claim 14 further comprising reducing pressure in an interior of the cavity to facilitate collapse of the cavity about the tubing.

16. The method of claim 8 wherein flowing fluid through the underreamer to operate the underreamer in forming the cavity comprises flowing fluid through a positive displacement motor of the underreamer to rotate a portion of the underreamer.

* * * * *